United States Patent [19]

Van Doorn et al.

[11] Patent Number: 4,610,575

[45] Date of Patent: Sep. 9, 1986

[54] APPARATUS FOR REMOVING QUANTITIES OF FIBER FROM BALES FOR BLENDING PURPOSES AND THE LIKE

[75] Inventors: Donald W. Van Doorn; James B. Hawkins; William A. Harmon; Terry L. McKenzie, all of Columbus, Ga.; Michael A. Hollingsworth, Phenix City, Ala.

[73] Assignee: Lummus Industries, Inc., Columbus, Ga.

[21] Appl. No.: 628,038

[22] Filed: Jul. 5, 1984

[51] Int. Cl.[4] ..... B65G 53/14

[52] U.S. Cl. ..... 406/113; 414/281

[58] Field of Search ..... 406/108–125, 406/167; 414/281, 134–136, 751, 627

[56] References Cited

U.S. PATENT DOCUMENTS

| | | | |
|---|---|---|---|
| 3,842,580 | 10/1974 | Franzen | 57/261 |
| 3,884,528 | 5/1975 | Shaddock | 406/152 X |
| 4,066,534 | 1/1978 | Arya | 414/627 X |
| 4,187,052 | 2/1980 | Hergeth | 414/627 X |
| 4,264,241 | 4/1981 | Hock | 406/109 |
| 4,365,764 | 12/1982 | Marx | 406/115 X |
| 4,376,602 | 3/1983 | Landmark | 406/115 |
| 4,475,269 | 10/1984 | Goldammer | 19/80 R |

FOREIGN PATENT DOCUMENTS

| | | | |
|---|---|---|---|
| 1035237 | 6/1966 | United Kingdom | 414/281 |

*Primary Examiner*—Jeffrey V. Nase
*Assistant Examiner*—L. E. Williams
*Attorney, Agent, or Firm*—Jennings, Carter, Thompson & Veal

[57] ABSTRACT

Disclosed is an apparatus for removing small quantities of fiber or like material from a plurality of bales of the same arranged in rows. The apparatus comprises angularly arranged conduits, one end of which is maintained in sealing relation to another and mechanism for moving up and down one of the conduits for removing the fiber from the bales. Improved sealing means for the mechanism comprises generally flat strips of material spanning and sealing slots in the upper surfaces of the conduits together with means to run under the strip of material without losing the seal. One of such mechanisms seals the two conduits together and the other such mechanism carries the actual pickup mechanism and seals it to the conduit up and down which it reciprocates. All of the mechanisms are under control of an operator who walks up and down the aisles between the rows of bales.

9 Claims, 17 Drawing Figures

APPARATUS FOR REMOVING QUANTITIES OF FIBER FROM BALES FOR BLENDING PURPOSES AND THE LIKE

BACKGROUND OF THE INVENTION

The blending of textile fibers for large lots historically has presented difficulties and has been very costly to attain. In certain textile goods, particularly carpets, precise uniformity throughout a lot is necessary to prevent "streaking", namely noticable change in color or texture of a carpet or other textile product which is not a part of the desired product variation. Blending in other textile operations, in large lots, also is desirable. Over the years, several schemes of blending large lots have been used. However, all of them are labor intensive or very costly both in terms of equipment and building space.

One system previously employed involves assemblying a small percentage at a time of bales of fiber to be blended and placing segments of these bales in a number of side by side opening machines which feed a common baling press. Up to 50 bales may be represented in one bale at the baling press. A succession of bales thus preblended are placed in a staging room sequentially in rows. After this first pre-blending the bales are then removed from these rows crossways from the way they were placed in the staging area. The removal of the rows of pre-blended bales from the staging area now will contain in each row fibers from the very first bales of the lot to the very last bales of the lot. These crossway rows of bales are then rerun through the same blending equipment and baling presses as the first pass. With these two passes a sufficiently uniform blend of fibers usually is obtained to eliminate obvious streaking.

Another prior art method of blending textile fibers for carpet yarns and the like is to employ huge blending chambers. These chambers may be approximately 100 feet long by 14 or 15 feet wide and 15 feet high. The fibers are fed from bales in succession to an opening machine or machines and an oscillating distributing device layers the fibers up and down the 100 foot length of the blending chamber until the chamber is filled. A typical full chamber will contain up to 50 bales. When the chamber or room is filled an unloading device removes the fibers from the chamber, starting at one end of the 100 foot length. The unloading device removes fibers simultaneously throughout the full height and width of the layered fibers; thus, a considerable amount of blending is accomplished. However, even if the lot size to be blended is no more than 50 bales representing the capacity of the chamber, a second stage of layering into a large blending chamber of the same type normally is used to insure the desired, proper blending. In many instances, however, the lot size desired to be blended exceeds the volumetric capacity of even these huge chambers; therefore, a succession of lots of fibers to be blended must be passed through the chambers. In order to assure that these successive lots are uniform from one to the other, the fibers must be baled after the first pass and collected in rows as with the first system above described. The fibers then must be rerun through the same equipment taking the bales away from the bale staging area in rows crosswise to the rows of bales as they were placed in the staging area.

In the blending of fibers for textile products other than carpet yarns, two systems currently are used. One system employs an overhead traveling grab mounted on a bridge in such fashion that the grab may travel the length of the bridge. The bridge is mounted on stationary tracks at either end so that it may travel from end to end of the tracks. In this way the grab may be positioned at any point over an area on which rows of bales are placed. The grab is moved downwardly until it contacts the surface of a bale whereupon the grab fingers close, grasping an indefinite amount of fibers. In practical operation the amount the grab picks up varies from nothing to perhaps 30 pounds. Once the grab has seized some of the fibers it is raised and travels along the bridge, the bridge in turn traveling along the tracks to a point where the grab releases its fibers into the succeeding opening and blending machine. While this system in some respects is satisfactory, it is limited in capacity since most all of its operating time is taken in travel to and from the respective bales to the succeeding blending machine. Since the grab involves fingers, this apparatus is very erratic in the amount of fiber removed and oftentimes drops some of the fibers on the way to the blending machine.

Another and perhaps the latest device being used today for general textile fiber blending is an apparatus that employs a floor-mounted traveling column. The travel of the column is limited to an oscillating motion up and down a straight path. Cantilevered to one side of the column, at 90 degrees from the direction of tower travel, is an arm supporting a mechanical device which can remove relatively uniform amounts of fiber from a single row of bales laid down under the cantilevered arm and running parallel to the travel of the tower. Also associated with this arm and tower and mechanical fiber removal device is a conduit through which air is drawn, thus to entrain the fiber removed from the successive bales. The conduit in the traveling tower is slidably connected to a stationary conduit which runs the length of the travel of the tower and has an open top. The open top of such conduit is covered by a sliding belt which passes over pulleys or wheels at either end of the conduit, the belt also running underneath the conduit. Thus, such belt makes a continuous loop over the two pulleys but is tied to the discharge end of the conduit carried by the tower leaving an opening between the moving and stationary conduits. The airborne stream of fibers passing through the conduit in the arm and tower are thus drawn into the stationary conduit. The belt just described makes an air-tight seal over the open top of the stationary conduit at all points except the point at which the conduit in the tower discharges the air and fiber into the stationary conduit. The stationary conduit has a discharge opening at one end from which the air and fiber pass to the succeeding blending machinery where the fibers are separated from the air stream. It will thus be seen that the apparatus just described has the advantage of continuous operation in which the fibers may be removed from the bale while the fiber is being conveyed from the bales to the succeeding blending machinery. The rate of fiber removal in this machine is considerably increased over the grab method described earlier. However, this last described method is limited to a single row or at most two rows of bales, at most 60 or 80 bales. Therefore this machine is not suitable for blending large lots of bales.

The foregoing describes the prior art as it is known to us. As will appear hereinafter our invention has for its general objects to overcoxe the several disadvantages of the above mentioned prior art apparatus.

SUMMARY OF THE INVENTION

Our invention relates to apparatus of the general nature set forth above and the specific object of our invention is to provide improvements in such apparatus. Specifically one of the major improvements in our invention relates to the manner in which the traveling conduit has its material delivery end maintained in sealing relation to the stationary one and in which, on said traveling conduit there is mounted for axial movement therealong a fiber pickup mechanism which in turn is sealed to the said traveling conduit.

Specifically, again, an object of our invention is to provide improved seals both for the pickup mechanism to its slotted, moving conduit and for the moving conduit to the slotted, stationary one.

More in detail, it is an object of our invention to provide said seals in the form of a flat strip of belt-like material which is non-movable in the axial sense and which spans the slots in the conduits and extends from end to end of the conduits, together with a sliding seal mechanism effective to couple the movable conduit to the stationary one and a similar seal to couple the pickup mechanism to the movable conduit, whereby the pickup may move up and down its conduit and the movable conduit may move up and down the length of the stationary conduit.

BRIEF DESCRIPTION OF THE DRAWINGS

Apparatus illustrating the features of our invention is shown in the accompanying drawings in which.

DETAILED DESCRIPTION

Figure 1:
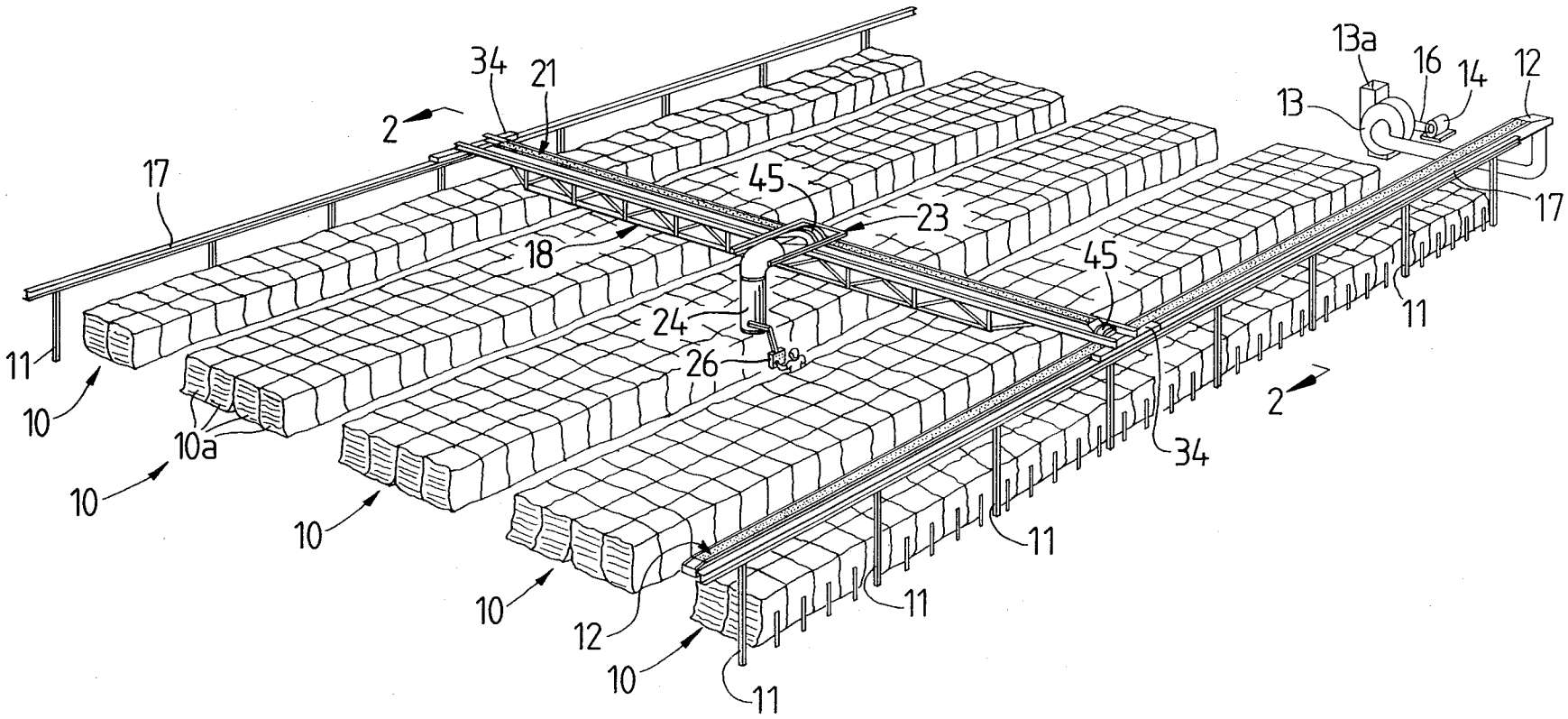
FIG. 1 is a wholly diagrammatic isometric view illustrating our invention in association with a plurality of rows of bales of fibers, each row in turn being made up of a plurality of bales of said fibers.
Figure 3:
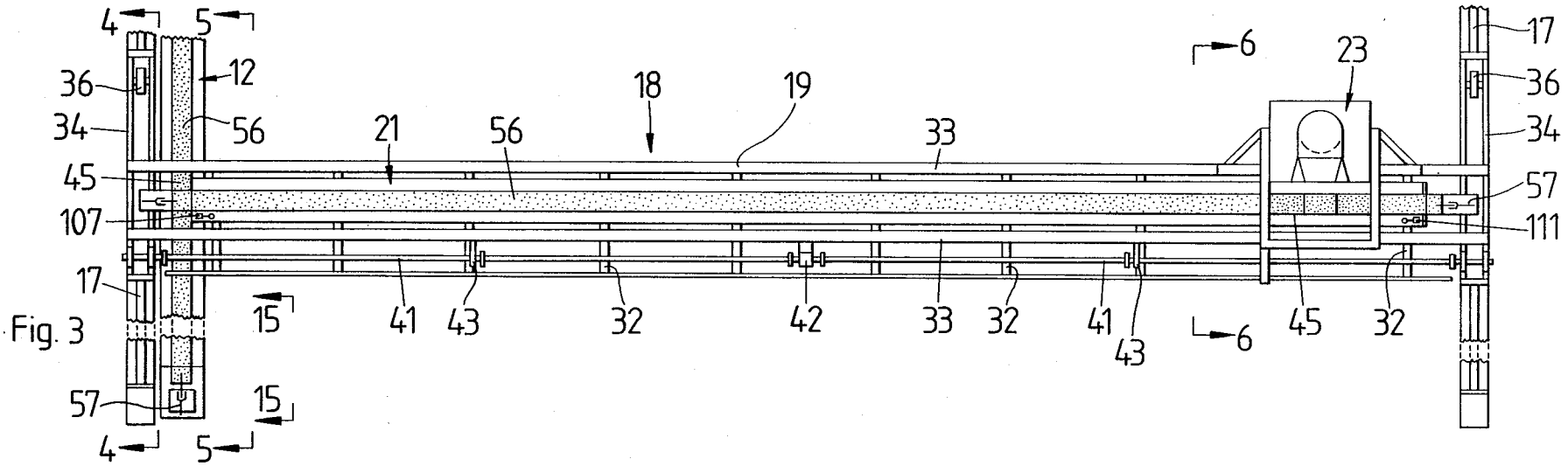
FIG. 3 is a fragmental detail plan view as viewed along line 3—3 of FIG. 2 and illustrating the carriage or slide for the pickup mechanism mounted on the traveling conduit.
Figure 2:
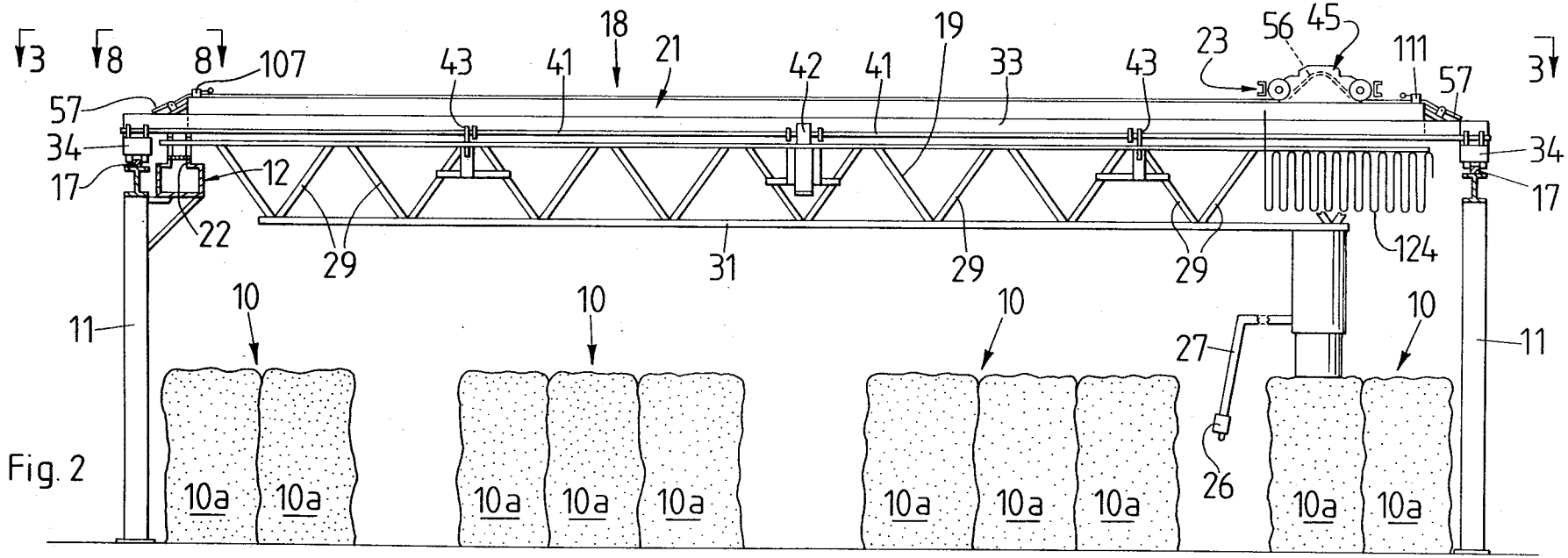
FIG. 2 is a somewhat enlarged, detail sectional view taken generally along line 2—2 of FIG. 1, certain of the parts being broken away and others omitted, for the sake of clarity.
Figure 5:
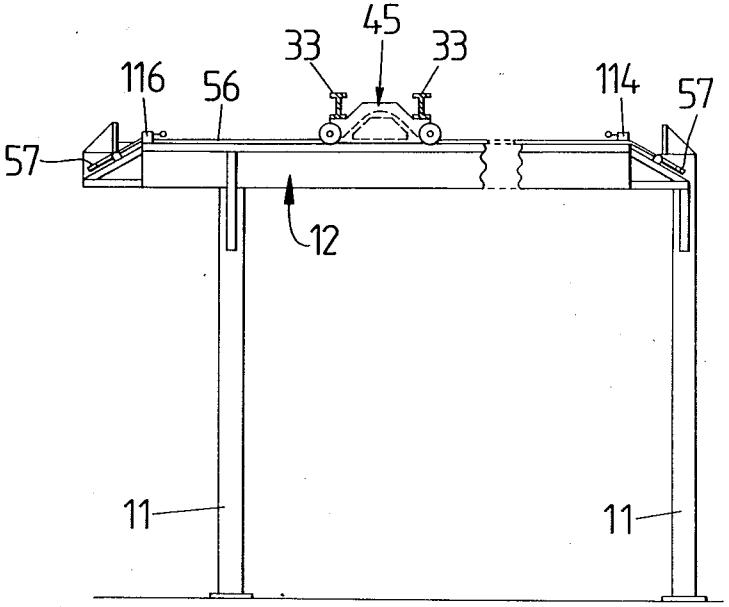
FIG. 5 is a detail sectional view taken generally along line 5—5 of FIG. 3.
Figure 4:
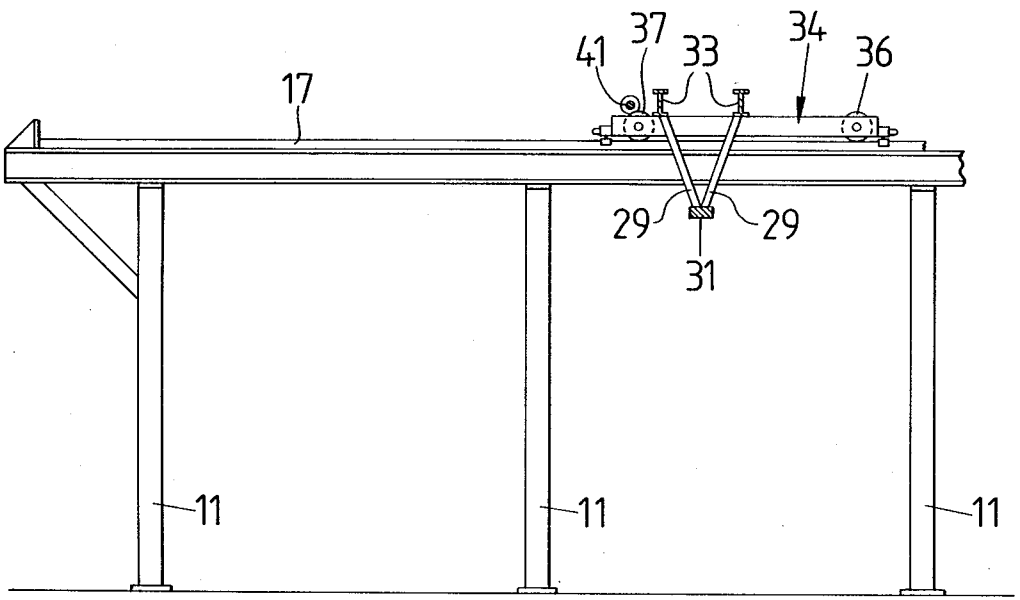
FIG. 4 is a detail sectional view taken generally along line 4—4 of FIG. 3.
Figure 7:
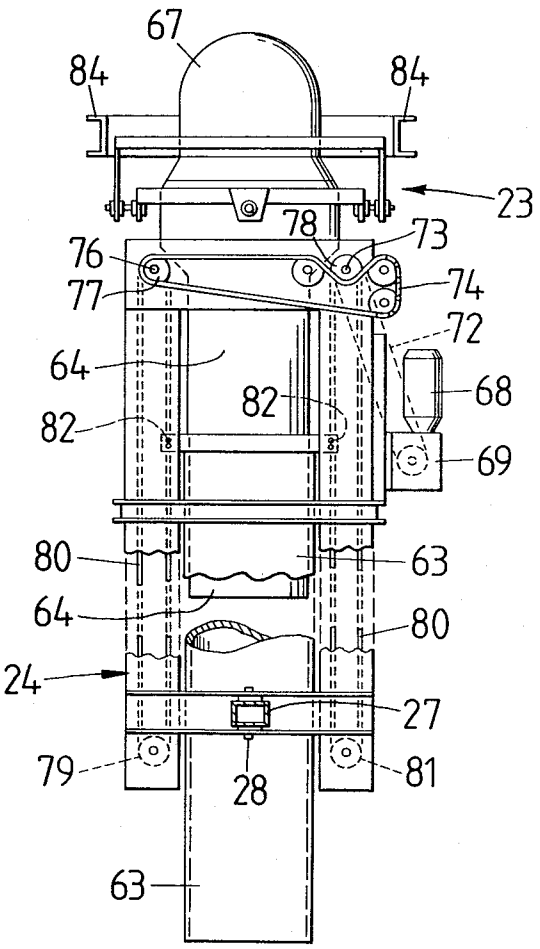
FIG. 7 is an elevational view, certain parts being in section, taken generally along line 7—7 of FIG. 7.

Referring now to the drawings for a better understanding of our invention, FIG. 1 illustrates overall what our invention is intended to accomplish. Thus, at 10 we show a plurality of side-by-side rows of bales of fibers, each row being made up of a multiplicity of individual bales 10*a* of the fibers. As will be understood, such fibers may be man-made fibers, natural fibers, a combination of the same, etc. The arrangement illustrated may be the placement of bales of raw fibers in a blending room at a textile plant.

Mounted on columns 11 and running generally parallel to the rows is a conduit 12. As later will be explained, the conduit is provided substantially along its entire length with an upwardly opening slot, sealed as will be explained, through which material is delivered from another conduit presently to be described. The conduit 12 is connected to the inlet of a suction fan 13 driven by a motor 14 through a belt or the like 16.

Also carried by the columns 11 are rails 17 as illustrated in FIG. 1. Mounted for reciprocation up and down the rails is an assexbly indicated generally by the numeral 18 which as later will appear consists of a supporting structure 19 and a second conduit 21. Both of the conduits 12 and 21 have upwardly opening slots therein indicated in the drawings at 22.

Mounted for movement axially along the conduit 21 is a fiber pickup mechanism indicated in the drawings generally by the numeral 23 and which includes a "telescope" section 24.

Also as later will appear, the telescope section itself has a motor for causing the same to raise and lower, the unit 23 is provided with a motor to cause the same to traverse the conduit 21 and the unit 18 is provided with a motor to cause the same to traverse the rails 17. All of the movements just mentioned are under control of an operator as shown in FIG. 1 by the manipulation of switches carried in a control box 26. The control box 26 is carried on an L-shaped arm 27 pivoted as at 28. See FIG. 6.

It will be understood that due to our improved sealing arrangement the conduits 12 and 21 are maintained in substantially air-tight engagement with each other and that due to the suction fan 13 both of such conduits are under negative pressure. Thus, the operator may walk up and down the aisles between the rows, passing the telescope, in sequence, over the tops of each of the bales of each of the rows whereby small quantities of fibers are removed sequentially from each bale. When the operator comes to the end of a row he simply walks around the row, it being noted that the control box 26 is carried on the end of the pivoted arm 27 as just described. Thus, small quantities of fiber from each of the bales is entrained through the telescope into the air stream induced by the suction fan whereby the blended fiber is delivered from the outlet 13*a* of the fan 13, for use in subsequent textile processes.

Referring now particularly to FIGS. 2 to 11, inclusive, it will be seen that the support 18 for the movable conduit 21 may comprise a bridge-like structure including web members 29 formed generally in the shape of a V and connected at their apices by a member 31. There are a plurality of the web members 29 and secured to the bases of the figure formed by the same are members 32.

Figure 9:
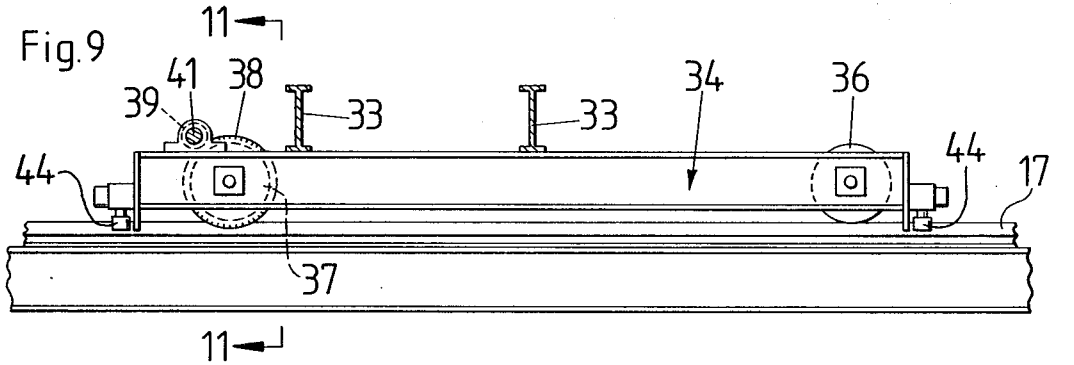
FIG. 9 is a detail view taken along line 9—9 of FIG. 8.
Figure 8:
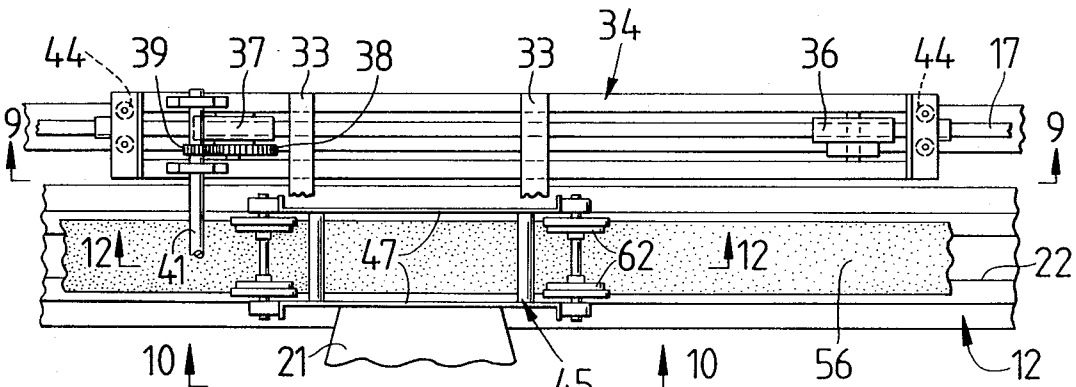
FIG. 8 is an enlarged detail plan view taken generally along lines 8—8 of FIG. 2 and illustrating in somewhat diagrammatic fashion the drive for moving the movable conduit along the stationary one.
Figure 10:
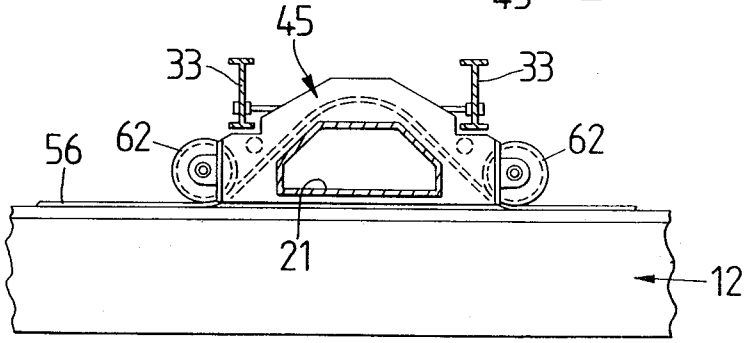
FIG. 10 is a detail view taken along line 10—10 of FIG. 8.

Spaced apart along the assembly just being described are I-beams 33, the bottom flanges of which carry members 32 and 29. As shown in FIG. 9, at one of their ends the I-beams rest on a carriage frame 34. The carriage at one end is provided with a roller 36 which rests on one of the rails 17. At its opposite end the carriage is provided with a second wheel 37 which carries non-rotatably therewith a gear 38. The gear 38 is in mesh with a pinion 39 fixedly mounted on a shaft 41. The shaft 41 is in effect double ended, that is, it is driven adjacent its center by a motor 42 and is supported by spaced bearings 43. The carriage is stabilized relative to the rails 17 by side rollers 44. Thus, when the shaft 41 rotates the entire unit 19 moves up and down the rails 17.

The conduit 21 is supported on top of the plurality of cross members 32. One end of the duct is closed by means of a plate 46 as shown particularly in FIG. 6.

In view of the fact that the mechanisms for sealing, that is, maintaining the pickup mechanism 23 in material transfer relation to the conduit 21 is the same as the mechanism used to seal the end of the conduit 21 to the conduit 12, a description of one will suffice for both.

Figure 12:
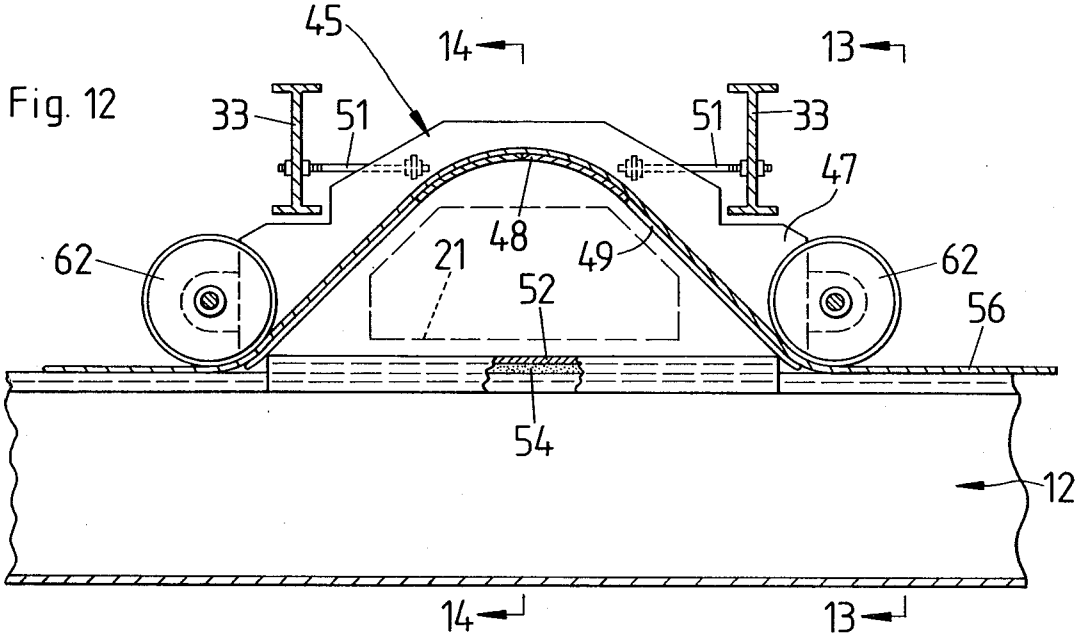
FIG. 12 is an enlarged sectional view along line 12—12 of FIG. 8 and illustrating the carriage for the movable conduit sealing arrangement associated therewith for sealing with the stationary conduit.

The sealing units 45 for connecting the pickup mechanism and for connecting the two ducts comprises side plate frame members 47. These members are spaced apart by an arcuate plate member 48 having downgoing legs as shown. The merber 48 is notched out at 49, on each of its downgoing legs to provide openings which communicate with the slot 22 in the conduit 12 or 21 respectively. The frame 47 and the member 48 forming a housing are carried by the I-beams 33 as illustrated by the use of rods 51, FIG. 12.

At the bottom of the side plate members 47 are inturned angle portions 52 which are turned downwardly at 53. The members 53 are positioned to slide inside of the upwardly opening slot in the respective ducts 12 or 21. On each side of the opening in the conduit, and immediately beneath the angle portions 52 are strips of sealing material 54 which are secured to the movable unit and slidable relative to the top of the duct.

Figure 15:
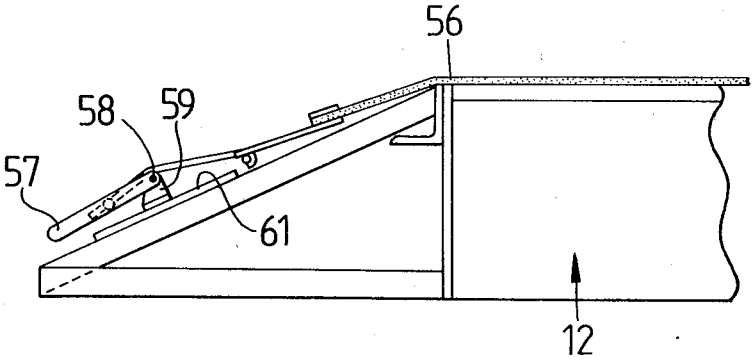
FIG. 15 is a detail elevational view along line 15—15 of FIG. 3 illustrating means for securing and tightening the sealing strips used to cover the slots in the conduits; and, FIG. 16 is a wholly diagrammatic wiring diagram.

Lying on top of each of the conduits 12 and 21, and covering the slots forming the top thereof is a strip of belt-like flexible material 56. As particularly illustrated in FIG. 15 each of the strips of material is anchored at each end by means of a snap lock device comprising a yoke member 57 pivoted at 58 to a lug 59 carried by a xember 61 secured to the framework as illustrated.

As shown in the drawings, the strip 56 of material passes under rollers 62 carried by the sealing unit member 54 thence upwardly over the curved section 48 and thence under a like roller 62 at the opposite end. With the length of material thus threaded under the rollers and upwardly and over the member 48, it will be seen that the conduit 21 is maintained in sealing relation to the mechanism to which the telescope is attached. In identical fashion the conduit 21 is maintained in substantially air-tight connection with the conduit 12 so that when material is picked up by the telescope and delivered into conduit 21 the air stream induced by the fan 13 delivers it through conduit 21 and through the slot 22 in the conduit 12, thence out through the fan.

Figure 6A:
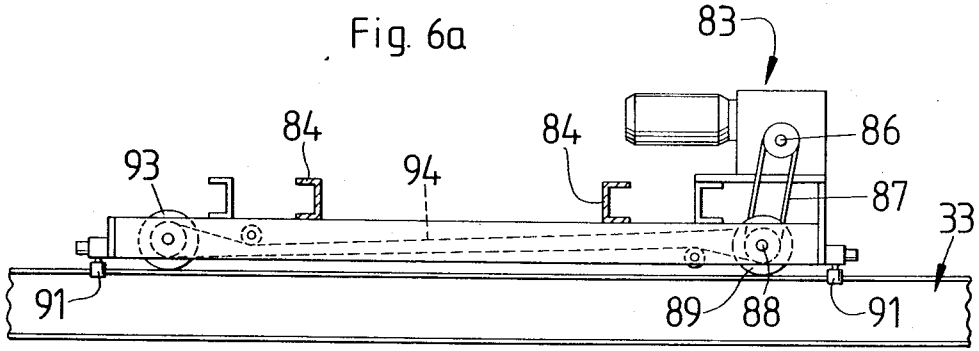
FIG. 6*a* is a detail sectional view taken generally along the line 6*a*—6*a* of FIG. 6.
Figure 6:
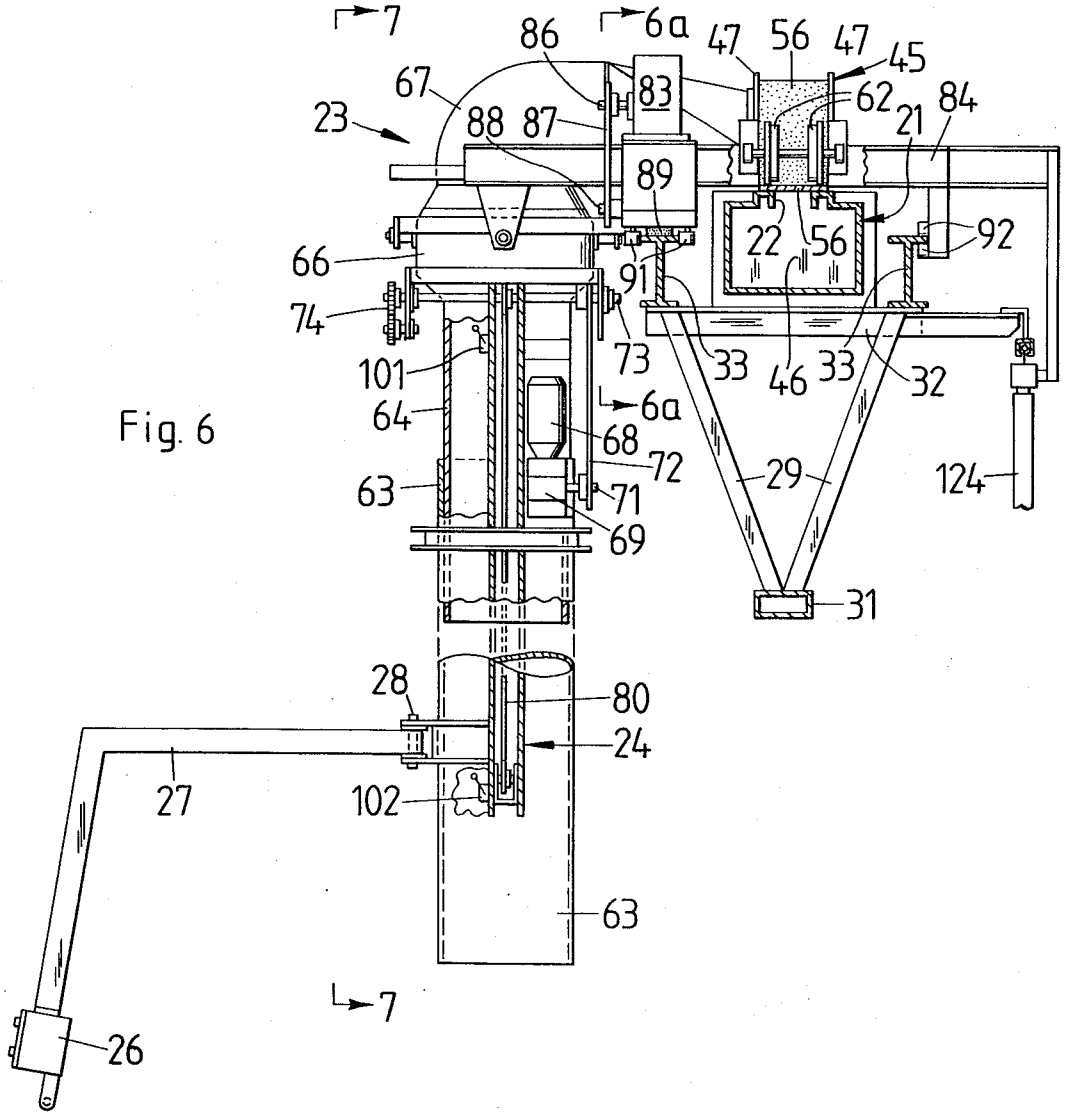
FIG. 6 is an enlarged detail sectional view taken generally along line 6—6 of FIG. 3.
Figure 11:
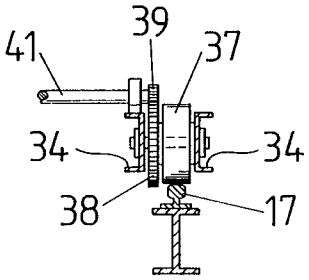
FIG. 11 is a detail sectional view taken along line 11—11 of FIG. 9.
Figure 13:
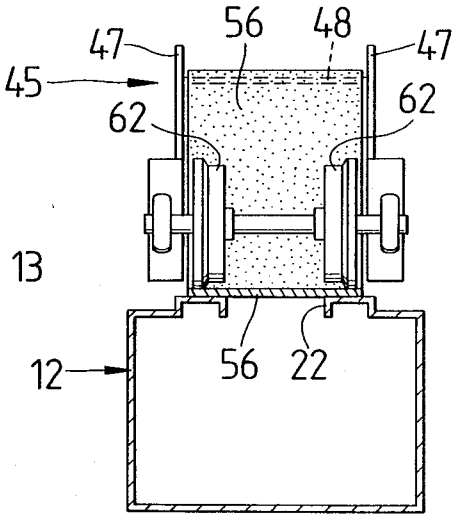
FIG. 13 is a detail sectional view along line 13—13 of FIG. 12.
Figure 14:
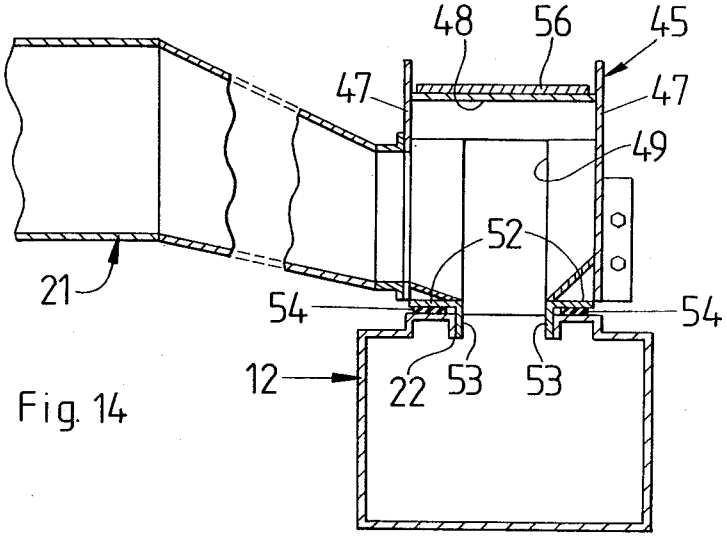
FIG. 14 is a detail sectional view along line 14—14 of FIG. 12.

Referring particularly to FIG. 6 the fiber pickup mechanism 23 of course includes the actual telescope or lower pipe 63. It will be understood that the lower tube 63 telescopes over an inner conduit 64 and that the inner conduit is connected through transition pieces 66 and 67 to the moving seal unit 45 which has been described and particularly illustrated in FIGS. 12, 13 and 14.

Mounted on the framework including the inner conduit member 64 is a motor 68 which drives a gear box 69 having an output shaft 71. A chain 72 passes over a sprocket on shaft 71 thence over another sprocket on a shaft 73. The shaft 73 and its sprocket drives a chain 74 which in turn drives a shaft 76. Passing over sprockets 77 and 78 are vertically disposed chains 80. These chains pass over lower sprockets 79 and 81 carried by the movable or telescoping tube part. The inner flights on each of the chains are secured at 82 to the outer telescoping portion or tube 63 whereby when the motor 68 is energized in one direction the tube is raised and when motor 68 is energized to rotate in the opposite direction tube 63 is lowered.

At 83 we show a reversible electric motor-gear box drive mounted on a channel structure 84 supported for movement up and down the I-beam rails 33. The output shaft 86 of the gear box drives a chain 87 which in turn drives a sprocket fast on a shaft 88. The shaft 88 carries a wheel 89 resting on top of one of the I-beam track members 33. Side stabilizing rollers 91, adjacent roller 89, and 92 cooperate with the rail to stabilize the device. It might be mentioned that the framework including the channel members 84 is provided also with another wheel 93 which is driven through another chain 94 from shaft 86.

From what has been described it will be seen that the movable sealing units 45 associated with the fiber pickup mechanism and between the two upwardly opening conduits permits the conduits to be arranged substantially 90 degrees to each other and to move relative to each other while conveying fiber from one to the other. In similar manner the pickup mechanism is free to travel up and down the length of the movable conduit, all the while delivering fiber from the bales to be carried by the airstream through the respective conduits and out for delivery through the blower outlet 13*a*.

Figure 16:
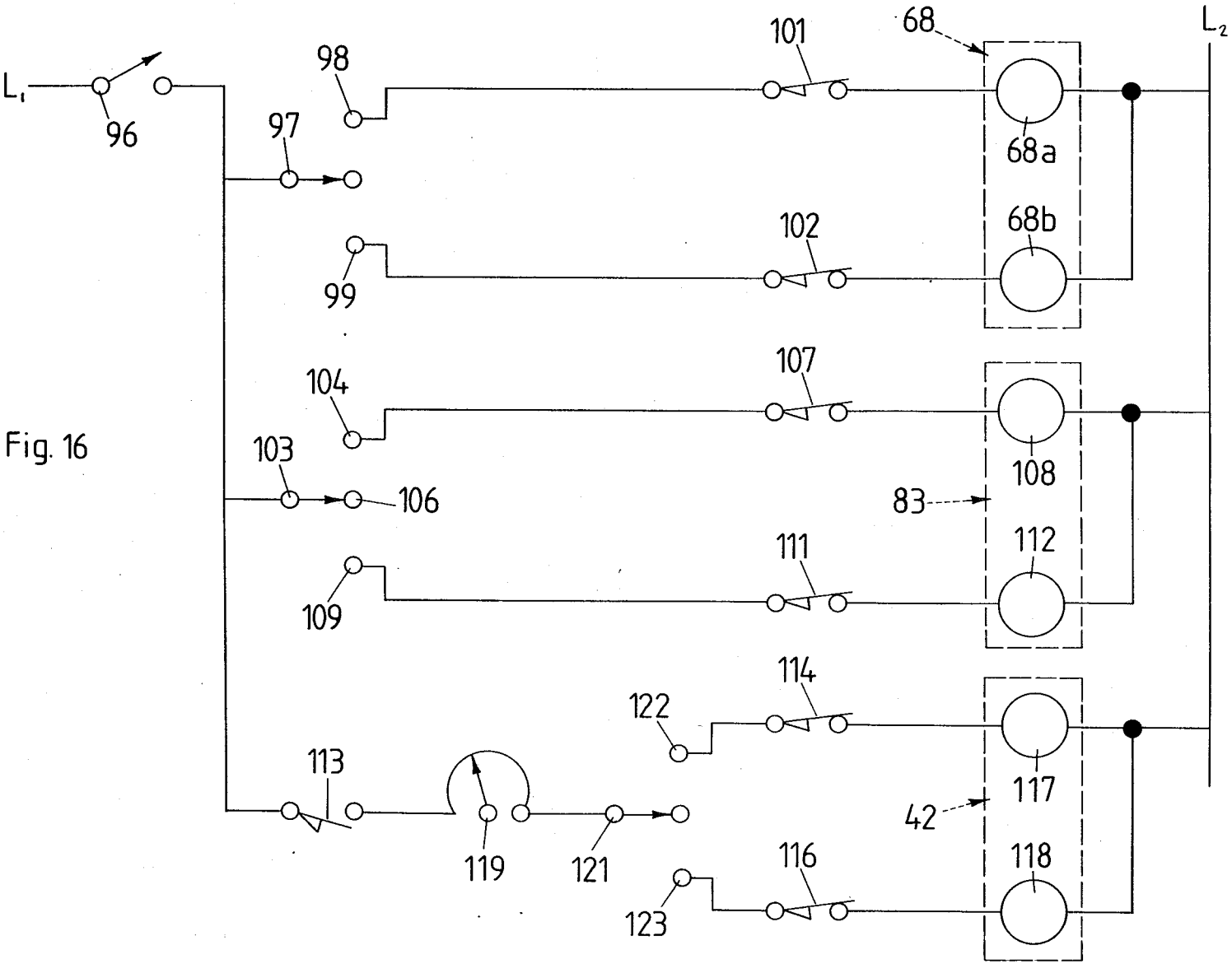

Referring now to the schematic wiring diagram, FIG. 16, we show a master switch 96 controlling power supply line L1. First, to cause the telescope to move up and down, the operator moves a selector switch 97 through a hand control mechanism either to the up position 98 or the down position 99 or to a neutral position to stop up and down movement. As illustrated the circuit is provided with an up limit switch 101 and a down limit switch 102. The motor 68 illustrated diagrammatically in FIG. 16 is provided internally with a winding 68*a* which causes the motor to rotate in a direction to move the tube 63 up and a second winding 68*b* to cause the motor 68 to rotate in a direction to move the tube downwardly, both as controlled by switch 97. Switch 97 is spring biased to its neutral position.

At 103 we show another switch having three positions 104, 106 and 109. Through a limit switch 107 position 104 of switch 103 controls a winding 108 of motor 83 to cause the mechanism carrying the telescoping tube to move in one direction along the conduit 21. The position 109 of switch 103, through a limit switch 111, energizes a winding section 112 of motor 83 to cause the mechanism carrying the telescope to move in the opposite direction along conduit 21. Switch 103 is spring biased to neutral position 106 to provide a "dead man" safety to stop movement when the operator releases the control mechanism.

At 113 we show a switch which is spring biased to normal open position. This spring biased switch 113 provides a "dead man" feature to stop movement when the operator releases the control mechanism. This switch, through the circuitry illustrated and through limit switches 114 and 116 controls, respectively, a winding section 117 and 118 to cause motor 42 to move conduit 21 and its associated mechanism up and down the overhead rail system. Included in the circuit just described is a potentiometer 119 which may be used to vary the speed of travel and a selector switch 121 having positions 122 and 123 to cause rotation in the directions just mentioned.

With the foregoing in mind it will be seen that the operator simply walks up and down the aisles between the bales and manipulates the various switches as shown in FIG. 16, it being understood that all these except the limit switches are included in the unit 26. Thus, fiber is drawn up through the telescope, which is maintained at the proper level to pick up the fiber, into the movable or cross conduit 21 through the mechanism 23 thence into the conduit 12, and finally to be discharged at 13*a* from the blower. It will be particularly noted that our improved seal means consists of a single run of the flexible material 56 as distinguished from the prior art concept of having what in effect amounts to an endless belt trained over rollers at each end. Since we anchor the strips at their ends by the mechanism shown in detail in FIG. 15, we can regulate the tautness of the strips as they pass over the moving sealing carriage-like mechanisms 45. When the operator comes to the end of the row he simply walks around it inasmuch as the control unit 26 is on the arm 27 which is pivoted at 28, it being understood that the wiring for the device may run through the arm 27 up to the various motors, limit switches, etc. As shown diagrammatically in FIG. 2 power may be supplied through the usual sliding loop cable arrangement shown diagrammatically at 124, one end of which of course is connected to a source of power, not shown. It will be seen that we provide an effective seal between the otherwise open conduits and between the traveling conduit and the fiber pickup mechanism by the arrangement of the sealing units 45 over which the strip loops as the members move up and down the rails or conduit, respectively. While there is a minor amount of leakage just at the juncture of the ends of seal 54 and the sealing strip 56, this is not, in practice, of consequence.

In view of the foregoing it will be seen that we have devised an improved apparatus for removing quantities of fiber and the like from a plurality of bales, in sequence or otherwise if desired. Our improved apparatus is characterized by efficient sealing and simplicity of construction.

While we have shown our invention in but one form, it will be obvious to those skilled in the art that it is not so limited, but is susceptible of various changes and modifications without departing from the spirit thereof.

What we claim is:

1. In apparatus for removing quantities of staple fiber or like material from a plurality of differing units of the same such as bales located adjacent each other on a horizontal surface, (a) a horizontal stationary material conveying air duct, (b) a horizontal traveling material conveying air duct associated with the stationary air duct into which material collected into the traveling air duct is delivered, and (c) material pick-up means having a discharge movable along the length of and associated with the traveling duct, whereby material from the plurality of bales may be moved from the bales into the pick-up means thence into the traveling and stationary air ducts.

2. In apparatus for removing quantities of fiber-like material from bales or the like of the same arranged generally in parallel rows, (a) a pick-up mechanism disposed to remove said quantities of material from the bales, (b) a first material conveying air duct arranged transversely of the rows of bales and movable along the rows of bales, (c) means connecting the pick-up mechanism to said air duct for movement along the length of the air duct and for delivering said material into the air duct while so moving, (d) a second mterial conveying air duct arranged generally parallel to the rows of bales, and (e) means associating the first air duct with the second air duct for movement along the length thereof whereby material being delivered by the movable pick-up into the first air duct while moving therealong in turn is delivered by the first air duct into the second air duct while moving therealong.

3. In apparatus for removing quantities of fiber-like material from bales or the like of the same arranged generally in parallel rows, (a) mechanism operable to pick up from the bales quantities of fibers and entrain them into an air stream moving into said mechanism, (b) a substantially air-tight conduit extending generally perpendicularly to the rows of bales and movable along the rows, (c) means connecting the pick-up mechanism to said conduit for movement axially therealong while delivering said fiber-air stream into said conduit, (d) a second substantially air-tight conduit fixedly mounted generally parallel to the rows of bales, and (e) means operatively connecting said conduits, whereby as the pick-up mechanism moves along its conduit the air-fiber stream is delivered into the movable conduit and by the latter into the fixed conduit.

4. Apparatus as defined in claim 3 wherein said means connecting said conduits comprises:

(a) a slot extending along the length of said fixedly mounted conduit;

(b) a flexible member fixedly attached adjacent the ends of said slot and sealably covering said slot; and (c) means associated with said conduits and said flexible member for maintaining a sealing relation between said conduits while material is fed from said movable conduit into said fixed conduit through said slot while said movable conduit is moving along the length of said fixedly mounted conduit.

5. Apparatus as defined in claim 3 in which the rows of bales are, relative to the conduits, rotated 90°, whereby the fixed conduit then extends generally perpendicular to the rows and the movable conduit extends generally parallel to the rows.

6. In apparatus for pneumatically conveying material under pressure different from atmospheric, (a) a pair of substantially air-tight conduits through which the material passes, (b) means maintaining a first one of the conduits for movement axially along the second one, (c) means to maintain the conduits operatively connected in material carrying relation comprising:

(1) a slot extending axially of the second one of the conduits, (2) an elongated flexible member sealably covering the slot, (3) a member carried by the first of such conduits having a portion effective as the conduits move relative to each other to separate the flexible member from the slot along a length of the slot, (4) means also carried by said first conduit effective to maintain sealing relation between the conduits along the length of said slot where said portion has separated the flexible member from the slot as the conduits move relative to each other, and (d) pick-up means operatively attached in substantially air-tight relation to said first conduit for axial movement therealong such that said pick-up means may be located at any position within a horizontal area defined by said pair of substantially air-tight conduits.

7. Apparatus as defined in claim 6 in which the flexible member sealably covering the slot is held against axial movement.

8. In apparatus useful as a part of a fiber blending system, (a) a fiber pick-up mechanism constructed and arranged to remove quantities of fiber from a plurality of bales of fibers arranged in a plurality of side-by-side rows, (b) two fiber transporting conduits, a first one of which is fixedly mounted alongside and parallel to the rows of bales, and the second of which is disposed normal to the rows and mounted for movement up and down the rows, (c) means mounting the fiber pick-up mechanism for reciprocation along the length of the second conduit, said mounting means including structure effective to maintain the fiber pick-up mechanism in sealed, fiber delivering relation to the second conduit as said mechanism moves therealong, (d) there being a slot in the first conduit extending substantially the length thereof, (e) means mounting one end of the first conduit in sliding relation to the second conduit, such means also including means to maintain said end of the first conduit in fiber delivering, sealed relation to the second conduit while at the same time permitting the movable conduit to move up and down the length of the fixed conduit while fiber is being delivered to the fixed conduit from the movable one.

9. In apparatus for removing quantities of fiber-like material from bales or the like of the same arranged generally in parallel rows:

(a) pick-up mechanism disposed to remove said quantities of material from the bales;

(b) a first material conveying air duct arranged parallel to the rows of bales and movable across the rows of bales;

(c) means connecting the pick-up mechanism to said first air duct for movement along the length of said first air duct and for delivering said material into the air duct while so moving;

(d) a second material conveying air duct arranged generally transversely of the rows of bales and offset from said first air duct; and (e) means associating the first air duct with the second air duct for movement along the length thereof whereby material being delivered by the movable pick-up into the first air duct while moving thereby in turn is delivered into the second air duct while moving theralong.

* * * * *